United States Patent [19]

Coope et al.

[11] 4,046,364

[45] Sept. 6, 1977

[54] TORQUE LIMITING VISE FOR HOLDING WORK ON A MACHINE TOOL TABLE

[75] Inventors: Robert L. Coope; Lowell W. Munson, both of Phoenix, Ariz.

[73] Assignee: Stevens Engineering, Phoenix, Ariz.

[21] Appl. No.: 728,751

[22] Filed: Oct. 1, 1976

[51] Int. Cl.[2] ..... B25B 1/10

[52] U.S. Cl. ..... 269/244; 81/52.4 A

[58] Field of Search ..... 269/240, 243, 244, 245, 269/321 A, 32; 81/52.4 A

[56] References Cited

U.S. PATENT DOCUMENTS

| | | | |
|---|---|---|---|
| 1,954,708 | 4/1934 | Mass | 269/321 A |
| 3,095,190 | 6/1963 | Freund | 269/32 |
| 3,585,817 | 6/1971 | McCafferty et al. | 81/52.4 A |

*Primary Examiner*—Robert C. Watson

[57] ABSTRACT

The disclosure relates to a torque limiting vise for holding work on a machine tool table. The vise has a pair of relatively adjustable jaws between which parts may be clamped and held on a machine tool table and one of the jaws of the vise is advanced toward the other one by means of screwthreaded means having torque limiting means adapted to limit the torque of the screwthreaded means to a predetermined amount so as to limit the clamping force between the jaws to a predetermined amount, and thereby to limit mechanical deflection of the jaws to a predetermined amount so that each time a part is clamped between the jaws, the amount of deflection of the jaws is repeated and thereby permitting repeated machining operations with precisely the same holding position of the part between the jaws as it may relate to a cutting tool spindle axis of the machine tool upon which the vise is used.

4 Claims, 10 Drawing Figures

TORQUE LIMITING VISE FOR HOLDING WORK ON A MACHINE TOOL TABLE

BACKGROUND OF THE INVENTION

The prior art vise mechanisms used on tables of machine tools have been provided with mechanism for rapidly advancing one vise jaw toward the other until a clamping operation is reached, at which time the jaws are closed with means providing greater leverage for clamping and whereby the jaws may be separated or retracted from each other at a greater rate than the final clamping rate.

Such prior art vises have, however, not been provided with means for precisely limiting torque applied through screwthreaded means to the moveable jaw of the vise so as to precisely limit loading of the jaws against a part therebetween and to thereby limiting precisely the amount of deflection of the jaws which will provide for precision repeat operations during the successive machining of several precision parts.

SUMMARY OF THE INVENTION

The invention relates to a torque limiting vise for holding work on a machine tool table; the vise being provided with screwthreaded means for closing one vise jaw relative to the other and a manually operable shaft adapted to actuate the screwthreaded means and a torque limiting device such as a slippable clutch between the shaft and the screwthreaded means so as to precisely limit torque applied to the screwthreaded means for precisely limiting the force applied to the moveable jaw and hence, its clamping force in opposition to a stationary jaw. The slippable clutch mechanism of the torque limiting device is adjustable so as to predetermine the amount of force that the screwthreaded means applied to the moveable jaw of the device and to thereby precisely limit deflection of the jaws relative to the working axis of a machine tool and to thereby provide for the precise spacing or disposition of the stationary jaw of the vise relative to the machine tool spindle so that precise machining operations may be repeated on a series of successively machined parts.

The vise of the invention comprises the torque limiting means for limiting the force of the moveable jaw of the vise acting toward the stationary jaw of the vise operates to close the jaws to a predetermined loading against opposite sides of a part and sprag clutch means is provided for operating the moveable jaw actuating mechanism in the opposite direction for retracting the jaw after the torque limiting clutch has reached a torque force, which causes it to slip. Thus, the vise may be tightened until the actuating means slips in one direction and the sprag clutch provides positive action in the opposite direction to release the moveable jaw of the vise after the machining operation has been completed.

Precision locating means is also provided in connection with the vise and a subplate mechanism, which may be attached to the table of the machine tool so that the vise is precisely held in a setup position relative to the spindle of a machine tool. Whereby, due to a series of fixture positions on the subplate, the stationary jaw of the vise may be mounted in various spaced relationship to the moveable jaw of the vise as may be desired in relation to parts having various dimensions and which are machined by clamping them between the jaws of the vise.

Accordingly, it is an object of the invention to provide a torque limiting vise for holding work on a machine tool table wherein, torque limiting means is provided to limit the force of a moveable jaw of the vise as it acts against the stationary jaw with a part clamped between the jaws so that deflection of the stationary jaw may be precisely predetermined and therefore serve as a precise reference locator for parts relative to the cutter spindle axis of a respective machine tool.

Another object of the invention is to provide a novel torque limiting device for holding work on a machine tool table wherein, a sprag clutch is adapted for use in releasing the moveable jaw of the vise after it has been tightened by a slippable clutch mechanism to a degree in which the actuating shaft of the vise slips without actuating the moveable vise jaw.

Another object of the invention is to provide a novel work holding vise and subplate mechanism whereby the work holding vise may be supported on a machine tool table with the stationary jaw of the vise adjustable in spaced relation to the moveable jaw of the vise to provide for the holding of parts having a wide range of dimensions.

Another object of the invention is to provide a work holding vise for machine tools comprising precision means for locating a vise and its respective jaws relative to the operating axis of a machine tool.

Another object of the invention is to provide a torque limiting vise for holding work on a machine tool table which is extremely accurate in its operation, such as to provide for precise repeat operations in accordance with very close tolerance requirements.

Further objects and advantages of the invention may be apparent from the following specification, appended claims and accompanying drawings.

DESCRIPTION OF THE PREFERRED EMBODIMENTS

Figure 1:
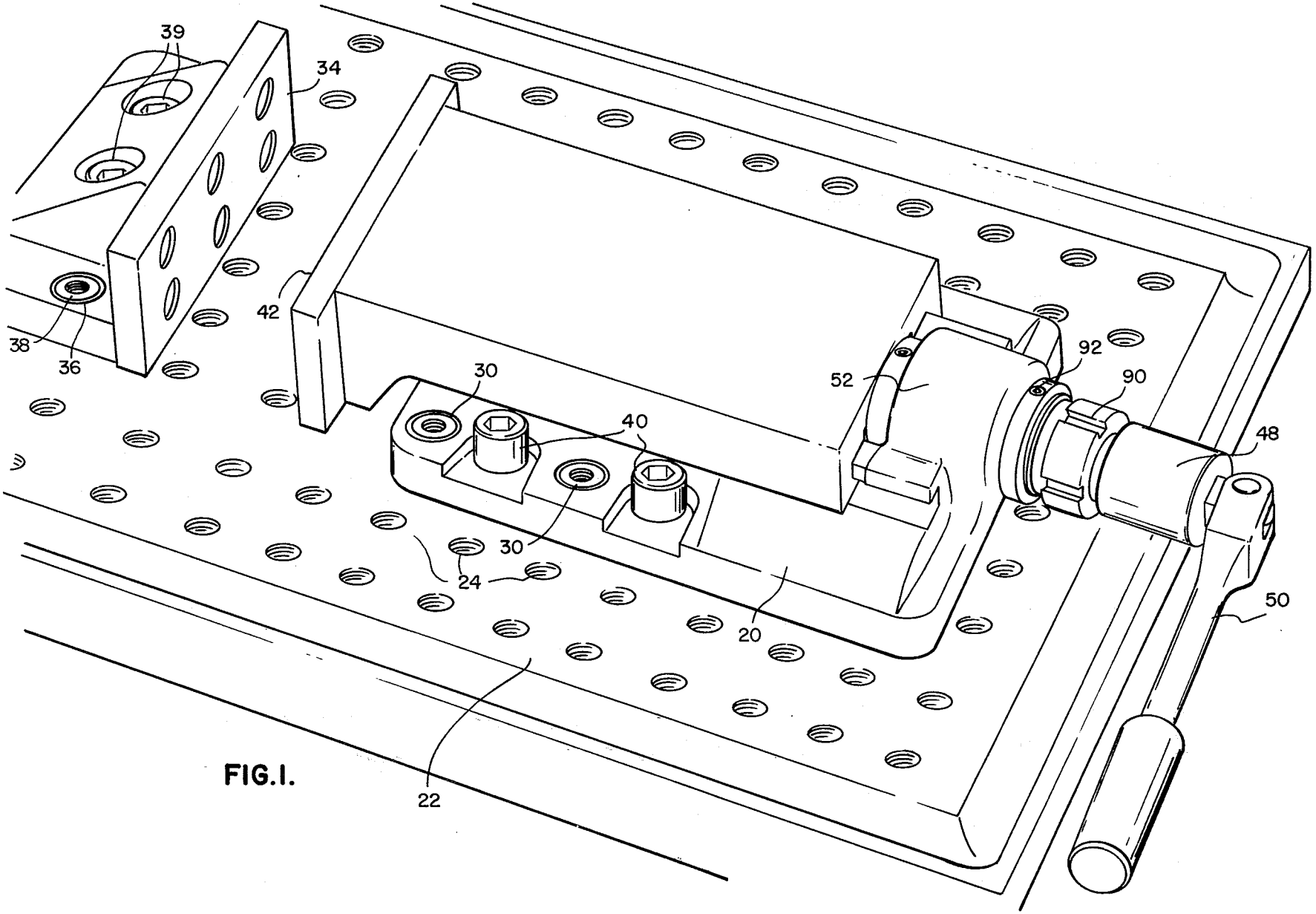
FIG. 1 is a fragmentary perspective view of a torque limiting vise for holding work on a machine tool table and showing a subplate for precision locating of the vise on a machine tool table.
Figure 2:
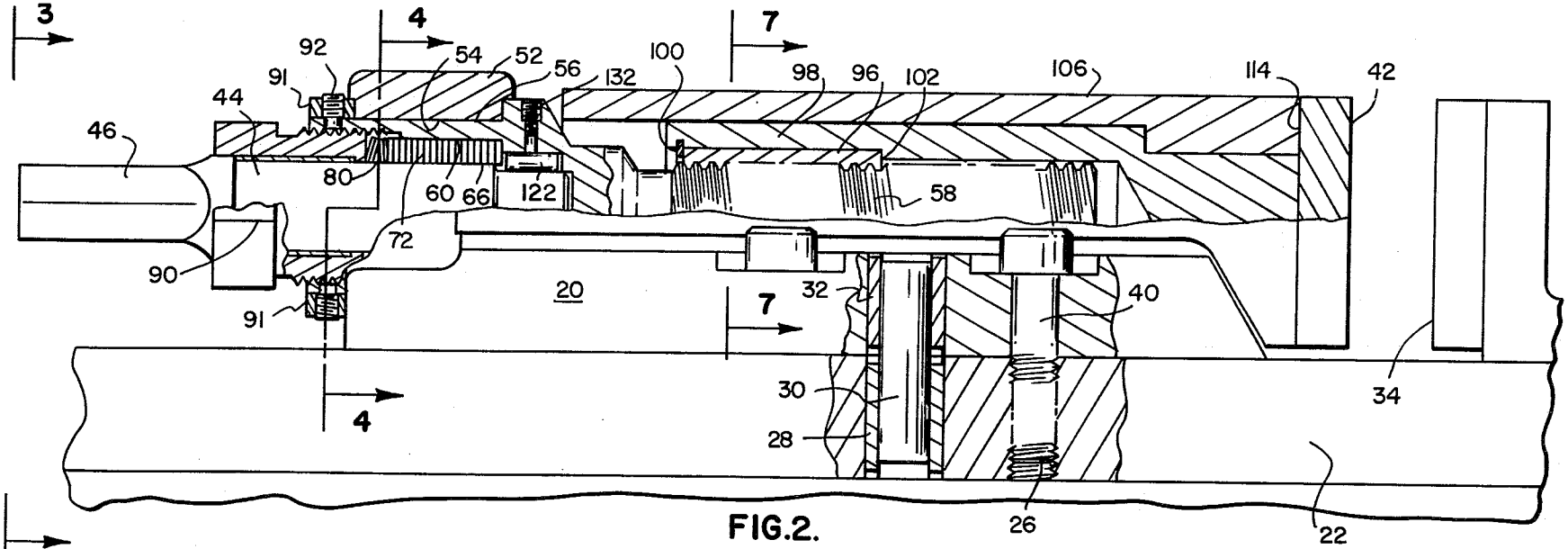
FIG. 2 is a fragmentary longitudinal sectional view of the torque limiting vise of the invention showing portions broken away and in section and showing portions in elevation to amplify the illustration.
Figure 4:
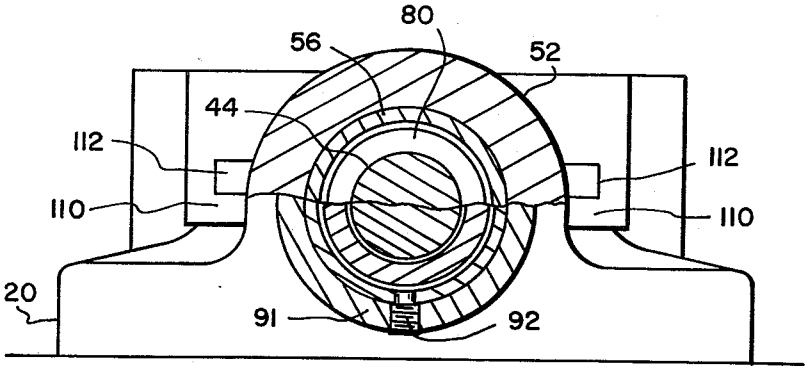
FIG. 4 is a sectional view taken from the line 4—4 of FIG. 2.
Figure 3:
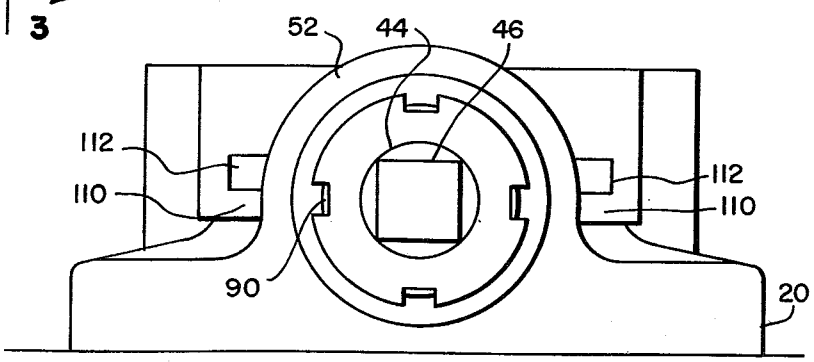
FIG. 3 is an end view of the vise taken from the line 3—3 of FIG. 2.

As shown in FIG. 1 of the drawings, the torque limiting vise of the invention is provided with a base frame 20 which is fixed on a subplate 22 having a series of openings 24, some of which are internally screwthreaded and some of which are provided with precision bushings therein, as shown in FIG. 2 of the drawings.

The subplate 22, as shown in FIG. 2, is provided with some holes which are internally screwthreaded, as indicated at 26 and some of the holes 24 are provided with precision bushings 28 therein in which precision dowels 30 are engaged and these dowels 30 extend into precision bushings 32 in the frame 20 of the vise. Likewise, as shown in FIG. 1 of the drawings, a separate jaw 34 of the vise is provided with precision bushings 36 similar to the precision bushings 32 and these bushings 36 are engaged by dowels 38 similar to the dowels 30. The internally screwthreaded opening 26 in the subplate 22 is engaged by a hold down bolt 40, which clamps the base frame 20 onto the subplate 22 and similar bolts 39 hold the stationary jaw 34, as shown in FIG. 1, down onto the subplate 22; the bolts 39 being screwthreaded into internally screwthreaded holes, such as the holes 26 which is one of the array of holes 24 shown in FIG. 1. Some of these holes are provided with the bushings and dowels, while other ones are internally screwthreaded and these holes are arranged in precise patterns so that the jaw 34 may be positioned in various spaced relation to the frame 20 of the vise, so that parts of varying size may be placed between the jaw 34, which is a stationary jaw, and the moveable jaw 42 of the vise, shown in FIG. 1 of the drawings.

As shown in FIGS. 1 and 2 of the drawings, the vise of the invention is provided with an actuating shaft 44 having a rectangular in cross section stub 46 on which a wrench socket 48 may be engaged and operated by conventional wrench handle 50, all as shown in FIG. 1 of the drawings.

The vise frame 20 is provided with a bearing portion 52 having a bore 54 therein. The bore 54 carries a hollow cylindrical portion 56 of an externally screwthreaded member 58. The hollow cylindrical portion 56 is rotatable in the bore 54 of the bearing portion 52 and the hollow cylindrical portion 56 is provided with an internal bore 60, shown best in detail in FIG. 6 of the drawings.

Figure 5:
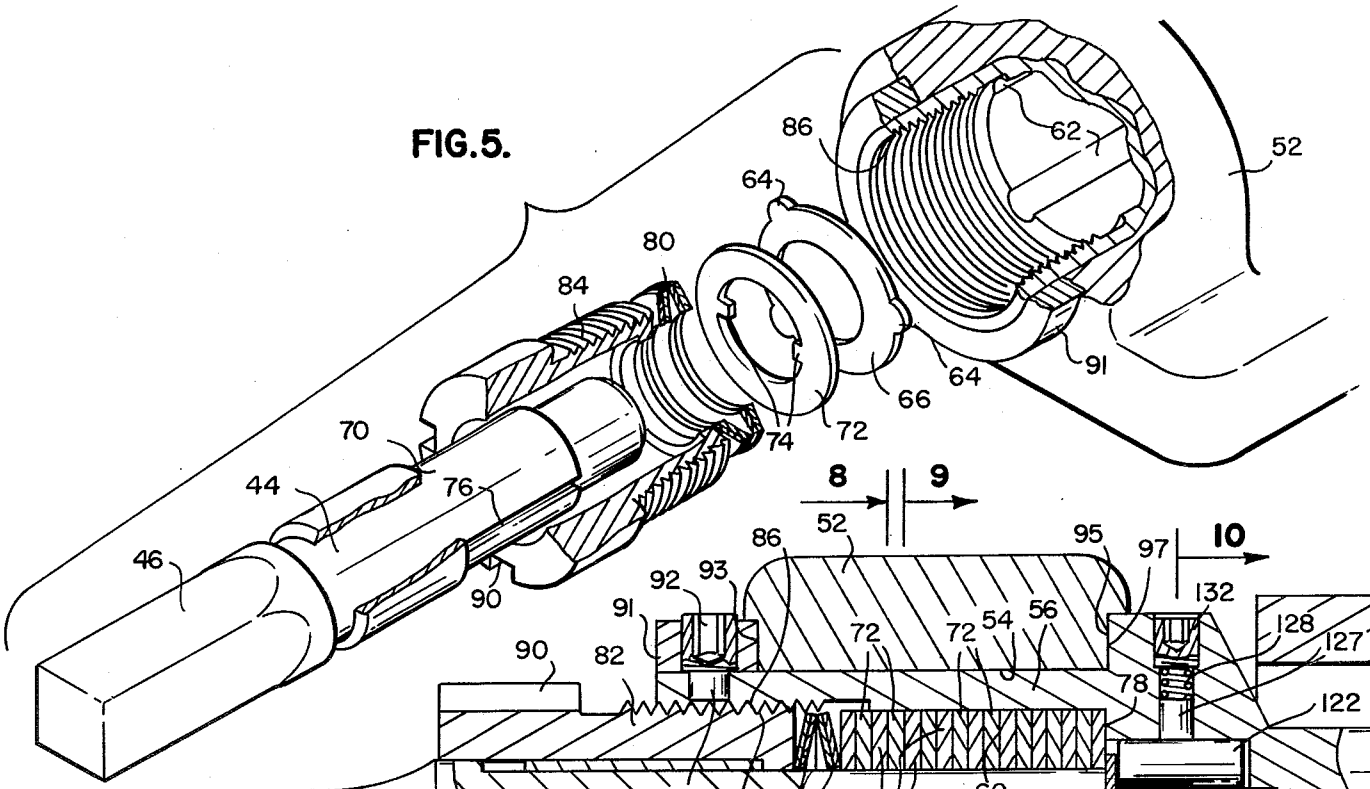
FIG. 5 is an exploded perspective view of the actuating shaft and clutch mechanism of the torque limiting vise of the invention.
Figure 8:
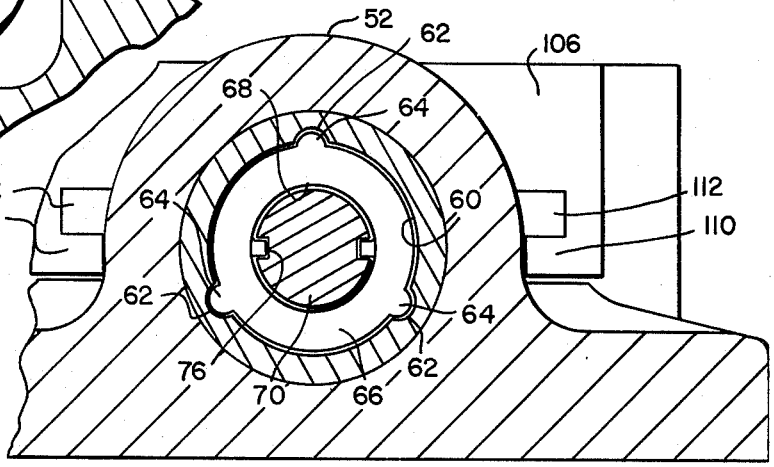
FIG. 8 is a reduced sectional view taken from the line 8—8 of FIG. 6.

The cross-sectional shape of this bore 60 is shown best in FIGS. 5 and 8 of the drawings. Referring to FIG. 8 of the drawings, it will be seen that the bore 60 is provided with three internally grooved portions 62 which extend longitudinally relative to the bore and parallel to its axis and these grooves 62 retain tabs 64 of clutch discs 66. The discs 66 are provided with annular openings 68 therein which surround a cylindrical portion 70 of the actuating shaft 44 and the actuating shaft 44 is freely rotatable in the bore or central opening 68 of each of the discs 66.

Figure 6:
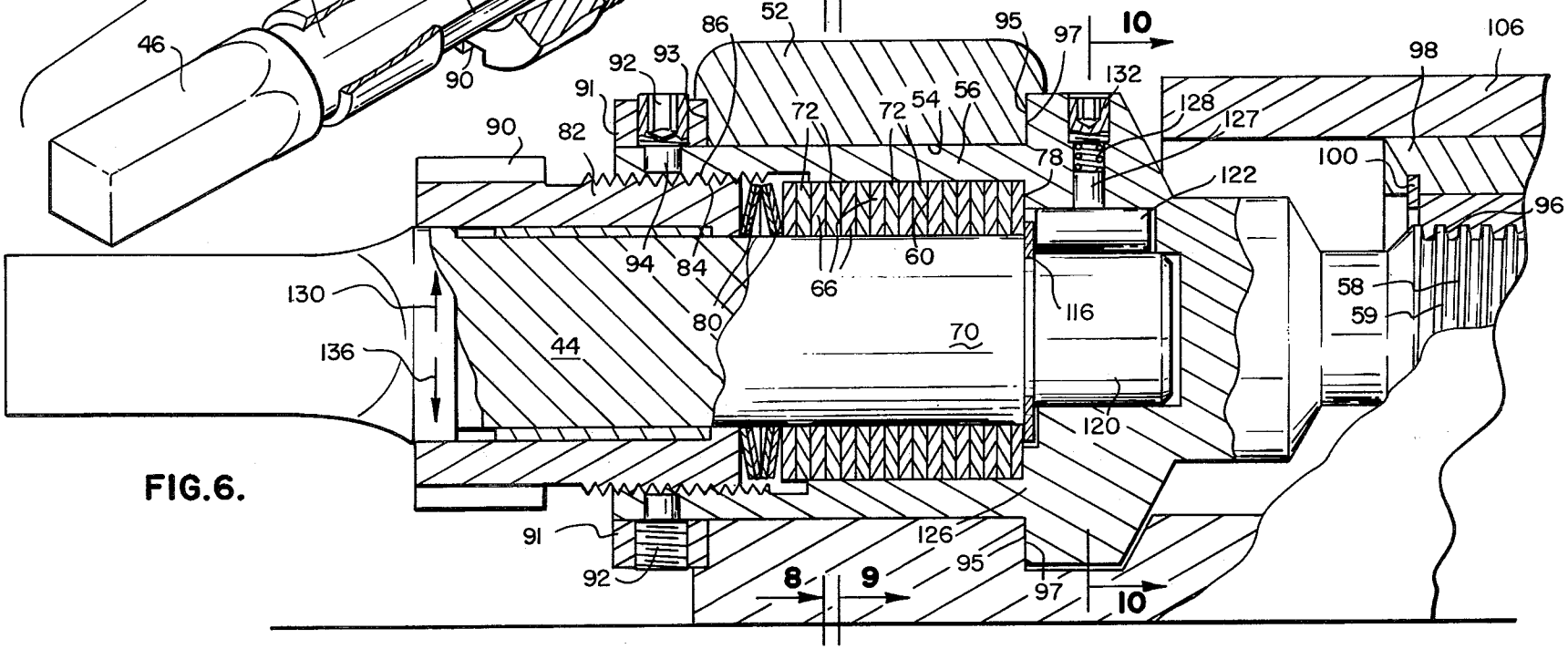
FIG. 6 is an enlarged sectional view taken on substantially the same plate as that shown in FIG. 2 and showing details of the torque limiting clutch mechanism.
Figure 9:
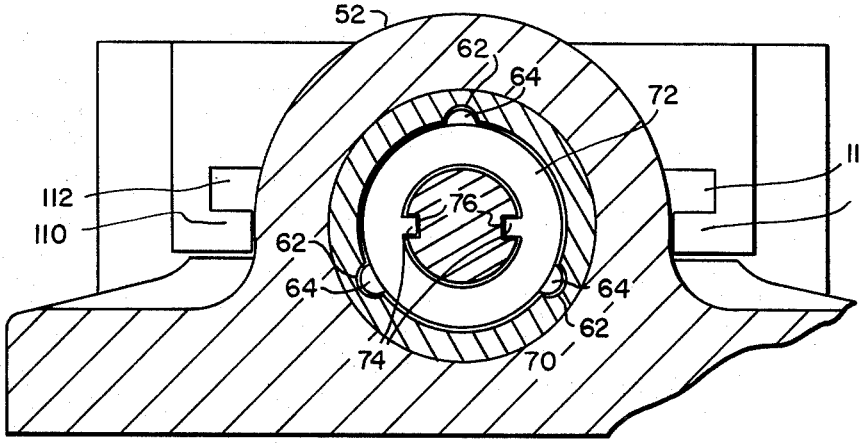
FIG. 9 is a reduced sectional view taken from the line 9—9 of FIG. 6.

As shown in FIGS. 5, 6 and 9 of the drawings, clutch discs 72 are disposed between the clutch discs 66. These clutch discs 72 are provided with inwardly directed tabs 74, which extend into slots 76 in the portion 70 of the actuating shaft 44. Thus, the discs 72 are restrained against rotation on the portion 70 of the actuating shaft 44 and the discs 66 are restrained against rotation in the bore 60 of the hollow cylindrical portion 56 of the screwthreaded shaft member 58.

The hollow cylindrical portion 56 is provided with a shoulder 78 against which the assembly of the discs 66 and 72 may bear and a set of bellville spring washers 80 are at the opposite end of the stacked assembly of discs 66 and 72 so as to apply force against the alternate discs 66 and 72 in a direction toward and against the shoulder 78; the bellville spring washers 80 are resiliently loaded by an adjustable sleeve 82 which is provided with external screwthreads 84 engaged in internal screwthreads 86 of the hollow cylindrical portion 56 of the screwthreaded member 58.

It will be seen that the member 82 is provided with external notches 90 adapted for use or engagement by a spanner wrench for advancing the externally screwthreaded portion 82 against the bellville washers 80 to apply a predetermined force against the discs 66 and 72 for forcing them against the shoulder 78. Thus, the discs are frictionally loaded relative to each other and a thrust ring 91 is held by bolts 92 and portions 94 thereof which extend into the hollow cylindrical portion 56 of the screwthreaded member 58. The ring 91 engages a bearing end 93 of the bearing 52 and holds a thrust shoulder 95 of the screw 58 adjacent to a thrust bearing portion 97 of the frame bearing portion 52. Thus, the discs are frictionally loaded relative to each other and provide for the hereinbefore described torque limiting function. Therefore, a predetermined amount of frictional engagement is attained between the discs 66 and 72 and consequently a predetermined amount of torque is required to cause the discs 72 to slip relative to the discs 66 and thus, the externally screwthreaded portion 59 of the shaft 58 is actuated internally of an internally screwthreaded nut 96 carried by a moveable jaw carriage member 98, which carries the moveable jaw 42; the operation of which will be hereinafter described in detail.

Figure 7:
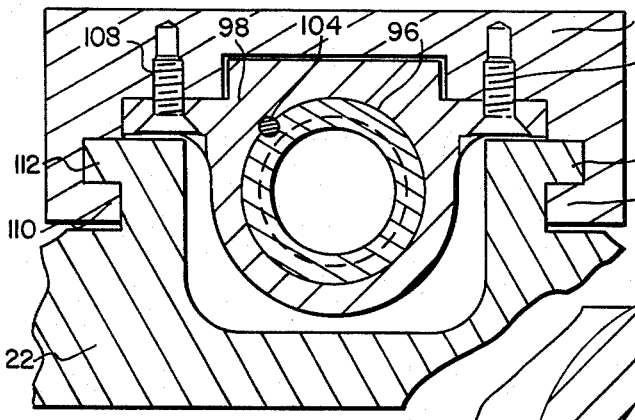
FIG. 7 is a fragmentary sectional view taken from the line 7—7 of FIG. 2.

The internally screwthreaded nut 96 is retained in the jaw carriage 98 by means of a snap ring 100 which holds the nut 96 against a shoulder 102 in the jaw carriage 98. As shown in FIG. 7 of the drawings, a locking pin 104 prevents relative rotation of the nut 96 in the jaw carriage 98. The jaw carriage 98 is fixed to a slide member 106 by means of screws 108, all as shown in FIG. 7 of the drawings. The slide member 106 is provided with slide bar portions 110 which interengage with complemental slide bar portions 112 of the frame 22 of the vise.

The slide member 106 is provided with an end portion 114 which abuts the jaw plate 42 which is fixed to the jaw carriage 98 hereinbefore described.

As shown in FIG. 6 of the drawings, a snap ring 116 disposed in an external groove in the actuating shaft 44 engages internally directed tabs 74 of the discs 72 and retains the shaft 44 against longitudinal displacement from the clutch disc assembly, which comprises the discs 66 and 72, all as shown best in FIG. 6 of the drawings.

Figure 10:
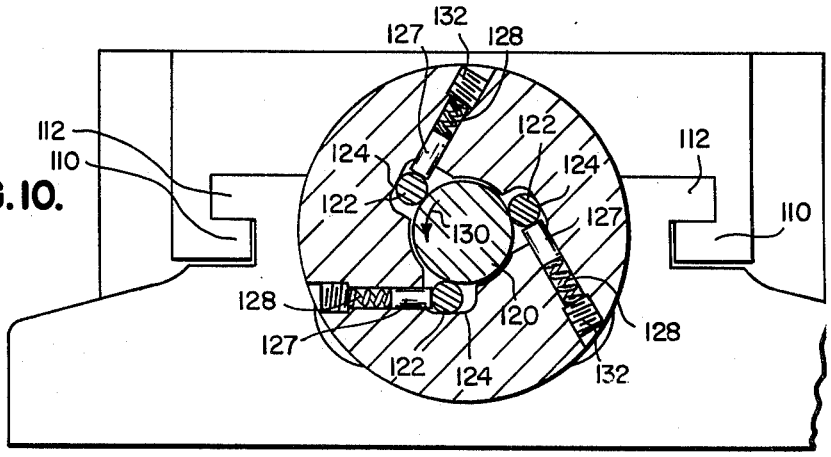
FIG. 10 is a reduced sectional view taken from the line 10—10 of FIG. 6.

As shown in FIGS. 6 and 10 of the drawings, a sprag clutch mechanism operates on the periphery of a sub portion 120 of the actuating shaft 44. This sprag clutch mechanism comprises a plurality of roller sprags 122 operating in recesses 124 in the sprag housing portion 126 of the externally screwthreaded member 58.

These sprag rollers 122 are actuated by plungers 127 forced by springs 128 radially inward to cause the sprag rollers 122 to actuate on the slightly inclined surface 124 so as to force them into engagement with the periphery of the portion 120 such that the sprags lock against the periphery of the shaft portion 120 when it is rotated in the direction of the arrow 130 shown in FIG. 10 of the drawings. This direction is opposite to that in which the actuating shaft 44 is rotated to advance the nut 96 by means of the screwthreaded portion 58 shown in FIG. 6 of the drawings for moving the jaw 42 toward the jaw 34.

Externally screwthreaded plugs 132 retain the springs 128 and are adapted to adjust the spring loading of the springs 128 on the sprags 122 for most efficient operation of the sprag clutch.

In operation, when the shaft 44 if actuated in the direction of an arrow 136 in FIG. 6 of the drawings, the clutch discs 72 slip relative to the discs 66 when a predetermined amount of torque has been applied to the shaft 44 by means of the wrench 50. This predetermined amount of torque is, of course, adjusted by the springs 80 and the screwthreaded shaft 58 acting in the nut 96 will cause a predetermined amount of force of the jaw 42 to be exerted against a part engaged by the jaw 34 and when the torque exerted on the shaft 44 reaches a predetermined amount, the plate clutch slips and the force applied to the stationary jaw 34 causes a minute amount of deflection, which is always repeatable by torquing of the shaft 44 until the clutch plates slip relative to each other.

At this time, the shaft 44 is in such tightened position and the jaws 42 and 34 are so engaged that the shaft 44, when actuated, will continue to cause the clutch plates 66 and 72 to slip. Consequently, the sprag clutch involving the sprags 122 are then used to rotate the shaft 58 in the direction of the arrow 130 due to the fact that the sprags 122 positively engage at the stub 120 of the shaft 44 and thereby, positively coupled the screwthreaded shaft 58 so as to release the jaw 42 relative to the jaw 34.

It will be appreciated by those skilled in the art that a stationary jaw, such as the jaw 34, may be deflected in accordance with the amount of force applied thereto.

In highly precise machining operations, it is desired to maintain a definite reference for the work supported on a machine tool table. Therefore, it is desired to limit the deflection of the stationary jaw 34 to a precise degree which may be accurately repeated each time the vise is closed against a part to be machined so that each part will always bear a precise reference to the spindle of a machine tool which carries a cutting tool. Accordingly, it will be appreciated by those skilled in the art that the degree of deflection of the stationary vise jaw is predictable for repeat operations such that very close tolerances may be maintained from one part to the next part as parts are machined in the vise and released from and subsequent parts are placed in the vise and machined.

Therefore, the torque limiting characteristics of the vise of the invention is extremely important in limiting deflection of the stationary jaw of the vise to a predetermined amount which is very precise and further, the use of a positive sprag clutch to release the jaws affords convenience and precision.

It will be obvious to those skilled in the art that various modifications may be resorted to without departing from the spirit of the invention.

I claim:

1. A torque limiting vise for holding work on a machine tool table; means for fixing said vise on a machine tool table; said vise having a pair of holding jaws between which a part may be clamped and held during the performance of machine work thereon; means for forcing said jaws together with a predetermined amount of force which predetermines a precise degree of mechanical deflection of either or both of said jaws in response to pressure thereof against a part clamped between said jaws, whereby successively machined parts, held by said jaws, create precisely the same amount of deflection so that each successively machined part is held precisely in the same position relative to a cutting tool position of said machine tool; said means for forcing said jaws together comprising a rotatable jaw actuating shaft; screwthreaded means disposed for advancing one of said jaws toward the other one of said pair of jaws; and a torque limiting means coupling said shaft and said screwthreaded means; rotary force applied to said jaw actuating shaft is precisely limited by said torque limiting means, thereby precisely limiting force of said screwthreaded means applied to said one of said jaws; said torque limiting means being a slippable clutch; said slippable clutch provided with a plurality of first discs coupled to said actuating shaft; said clutch having a plurality of second discs coupled to said screwthreaded means; said first and second discs disposed alternately between each other and in contigous relationship; said actuating shaft and said screwthreaded means being on a common axis; and said discs being free to move into pressure contact with each other in a direction longitudinally of said common axis; and adjustable resilient means adjustable to apply force in a direction longitudinally along said common axis and against said first and second discs to thereby cause frictional engagement therebetween and to provide for the adjustment of a predetermined amount of torque transmitting force between said actuating shaft and said screwthreaded means before said first and second discs slip relative to each other while said actuating shaft is being rotated to force one of said jaws toward said other one of said jaws.

2. A torque limiting vise for holding work on a machine tool table; means for fixing said vise on a machine tool table; said vise having a pair of holding jaws between which a part may be clamped and held during the performance of machine work thereon; means for forcing said jaws together with a predetermined amount of force which predetermines a precise degree of mechanical deflection of either or both of said jaws in response to pressure thereof against a part clamped between said jaws, whereby successively machined parts, held by said jaws, create precisely the same amount of deflection so that each successively machined part is held precisely in the same position relative to a cutting tool position of said machine tool; said means for forcing said jaws together comprising a rotatable jaw actuating shaft; screwthreaded means disposed for advancing one of said jaws toward the other one of said pair of jaws; and a torque limiting means coupling said shaft and said screwthreaded means; rotary force applied to said jaw actuating shaft is precisely limited by said torque limiting means, thereby precisely limiting force of said screwthreaded means applied to said one of said jaws; said torque limiting means being a slippable clutch; a sprag clutch means is disposed relative to said actuating shaft and said screwthreaded means; said sprag clutch operable to drivingly connect said actuating shaft and said screwthreaded means when said actuating shaft is rotated in a direction opposite to that in which one of said jaws is forced towards the other one of said jaws by said screwthreaded means.

3. The invention as defined in claim 1, wherein: said screwthreaded means is provided with an externally screwthreaded member; said externally screwthreaded member having a hollow sleeve portion; said second discs keyed into the bore of said hollow sleeve portion; an internally screwthreaded nut having screwthreads cooperable with said screwthreaded member; a slide member having slide means; a base upon which said slide means is slideably mounted; and one of said vise jaws coupled to said slide means.

4. The invention as defined in claim 3, wherein: said sleeve portion of said screwthreaded means is provided with an open end extending beyond said discs and said resilient means; said resilient means being spring washers; said sleeve means near said open end provided with internally disposed screwthreads; and an adjusting nut rotatable about said actuating shaft and having external screwthreads engaging the internal screwthreads of said sleeve; said adjusting nut adapted to exert force on said spring washers and to thereby resiliently load said first and second discs together to vary the frictional engagement thereof and the resultant torque transmitting capability between said actuating shaft and said screwthreaded means.

* * * * *